US010197957B2

(12) United States Patent
Fujimoto et al.

(10) Patent No.: US 10,197,957 B2
(45) Date of Patent: Feb. 5, 2019

(54) FIXING DEVICE, IMAGE FORMING APPARATUS, AND FIXING DEVICE CONTROL METHOD

(71) Applicants: Ippei Fujimoto, Kanagawa (JP); Kazunari Sawada, Shizuoka (JP); Kenji Ishii, Kanagawa (JP); Hiroshi Yoshinaga, Chiba (JP); Takayuki Seki, Kanagawa (JP); Ryohei Matsuda, Kanagawa (JP)

(72) Inventors: Ippei Fujimoto, Kanagawa (JP); Kazunari Sawada, Shizuoka (JP); Kenji Ishii, Kanagawa (JP); Hiroshi Yoshinaga, Chiba (JP); Takayuki Seki, Kanagawa (JP); Ryohei Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/969,912

(22) Filed: May 3, 2018

(65) Prior Publication Data

US 2018/0348680 A1 Dec. 6, 2018

(30) Foreign Application Priority Data

Jun. 5, 2017 (JP) ..... 2017-110741

(51) Int. Cl.
*G03G 15/20* (2006.01)

(52) U.S. Cl.
CPC ..... *G03G 15/2039* (2013.01); *G03G 15/206* (2013.01); *G03G 15/2042* (2013.01)

(58) Field of Classification Search
CPC ..... G03G 15/2039–15/205
See application file for complete search history.

(56) References Cited

U.S. PATENT DOCUMENTS 6,393,230 B1 * 5/2002 Haneda ..... G03G 15/2053 219/216
2008/0170894 A1 * 7/2008 Ishida ..... G03G 15/2042 399/329

(Continued)

FOREIGN PATENT DOCUMENTS

JP 4-044083 2/1992
JP 2003-295680 10/2003

(Continued)

OTHER PUBLICATIONS

U.S. Appl. No. 15/783,199, filed Oct. 13, 2017 Hiroshi Yoshinaga, et al.

(Continued)

*Primary Examiner* — Carla J Therrien
(74) *Attorney, Agent, or Firm* — Oblon, McClelland, Maier & Neustadt, L.L.P.

(57) ABSTRACT

A fixing device includes a fixing rotator, a plurality of heat sources having different heat distributions to heat the fixing rotator, a pressing member to press the fixing rotator and form a nip to fix the unfixed toner image on the recording material, a shield disposed between the plurality of heat sources, a plurality of temperature sensors each disposed opposite to the heat source, a processor to control the plurality of heat sources so that a temperature detected by the temperature sensor becomes a predetermined target temperature. The processor controls the heaters so that a temperature difference ΔT=T2−T1 becomes greater than zero, wherein T1 is the target temperature for the temperature sensor close to an entrance of the nip, and T2 is the target temperature for the temperature sensor far from the entrance of the nip.

7 Claims, 5 Drawing Sheets

(56) References Cited

U.S. PATENT DOCUMENTS

| | | | | |
|---|---|---|---|---|
| 2013/0170879 | A1* | 7/2013 | Yoshinaga | G03G 15/2053 399/329 |
| 2016/0011548 | A1* | 1/2016 | Utsunomiya | G03G 15/206 399/329 |
| 2016/0223961 | A1 | 8/2016 | Takagi et al. | |
| 2016/0238975 | A1 | 8/2016 | Seki et al. | |
| 2016/0246228 | A1 | 8/2016 | Fujimoto et al. | |
| 2016/0274510 | A1 | 9/2016 | Hase et al. | |
| 2016/0274511 | A1 | 9/2016 | Ogino et al. | |
| 2016/0274514 | A1 | 9/2016 | Ishii et al. | |
| 2016/0378027 | A1 | 12/2016 | Sawada et al. | |
| 2017/0010570 | A1 | 1/2017 | Fujimoto et al. | |
| 2017/0176907 | A1 | 6/2017 | Sawada et al. | |
| 2017/0185009 | A1 | 6/2017 | Yoshinaga et al. | |
| 2017/0185015 | A1 | 6/2017 | Yoshinaga et al. | |
| 2017/0185020 | A1 | 6/2017 | Seki et al. | |
| 2017/0185021 | A1 | 6/2017 | Seki et al. | |
| 2017/0255147 | A1 | 9/2017 | Seki et al. | |
| 2017/0261900 | A1 | 9/2017 | Sawada et al. | |
| 2017/0364000 | A1 | 12/2017 | Seki et al. | |
| 2018/0011432 | A1 | 1/2018 | Yoshinaga et al. | |
| 2018/0017910 | A1 | 1/2018 | Sawada et al. | |
| 2018/0059587 | A1 | 3/2018 | Sawada et al. | |

FOREIGN PATENT DOCUMENTS

| | | |
|---|---|---|
| JP | 2004-286922 | 10/2004 |
| JP | 2011-237831 | 11/2011 |
| JP | 2015-146052 | 8/2015 |
| JP | 2016-153877 | 8/2016 |
| JP | 2016-212278 | 12/2016 |

OTHER PUBLICATIONS

U.S. Appl. No. 15/804,459, filed Nov. 6, 2017 Takayuki Seki, et al.
U.S. Appl. No. 15/827,085, filed Nov. 30, 2017 Takashi Seto, et al.
U.S. Appl. No. 15/924,631, filed Mar. 19, 2018 Ippei Fujimoto, et al.

* cited by examiner

BACK GROUND ART

FIXING DEVICE, IMAGE FORMING APPARATUS, AND FIXING DEVICE CONTROL METHOD

CROSS-REFERENCE TO RELATED APPLICATION

This patent application is based on and claims priority pursuant to 35 U.S.C. § 119 to Japanese Patent Application No. 2017-110741, filed on Jun. 5, 2017 in the Japanese Patent Office, the entire disclosure of which is hereby incorporated by reference herein.

BACKGROUND

Technical Field

Embodiments of the present disclosure generally relate to a fixing device, an image forming apparatus incorporating the fixing device, and a fixing device control method.

Background Art

Currently, there is increased demand for energy-efficient and high-speed image forming apparatuses such as printers, copiers, facsimile machines, or multifunction peripherals or multifunction printers (MFPs).

Typical image forming apparatuses execute an image forming process such as electrophotographic recording, electrostatic recording, or magnetic recording, to form and fix a toner image on a recording medium such as a recording sheet, printing paper, sensitized paper, or dielectric-coated paper, directly or indirectly. As part of such image forming apparatuses, a fixing device for fixing an unfixed toner image on the recording medium is widely used. As the fixing device widely adopted, there is a fixing device of a contact heating type such as a heat roller type, a film heating type, an electromagnetic induction heating type, or the like.

Examples of such fixing devices include belt type fixing devices, fixing devices using a ceramic heater, and fixing devices that directly heat a fixing belt with a halogen heater, thus saving energy.

Direct heating of the fixing belt with a halogen heater provides shortened warm-up times and energy efficiency. However, as such fixing devices are downsized, the endless belt incorporated therein is downsized to have a decreased loop diameter that reduces an interval between the first heater and the second heater disposed inside the loop formed by the endless belt.

Accordingly, if a first heater is parallel to a second heater, one of the first heater and the second heater may heat another one of the first heater and the second heater with radiant heat, degrading heating efficiency of the first heater and the second heater.

SUMMARY

This specification describes an improved fixing device, an image forming apparatus including the fixing device, and an improved fixing device control method.

In one illustrative embodiment, the fixing device includes a fixing rotator rotatable in a predetermined direction of rotation, a plurality of heat sources each having a different heat distribution in a longitudinal direction to heat the fixing rotator, a pressing member to press the fixing rotator and form a nip through which a recording material bearing an unfixed toner image passes to fix the unfixed toner image on the recording material, a shield disposed between the plurality of heat sources, a plurality of temperature sensors disposed opposite to the heat source with the fixing rotator interposed between the heat source and the temperature sensor, a processor to control the plurality of heat sources so that a temperature detected by the temperature sensor reaches a predetermined target temperature. The processor controls the heaters so that a temperature difference $\Delta T=T2-T1$ becomes greater than zero, wherein T1 is the target temperature for the temperature sensor close to an entrance of the nip in the rotation direction of the fixing rotator among the plurality of temperature sensors, and T2 is the target temperature for the temperature sensor far from the nip in the rotation direction of the fixing rotator among the plurality of temperature sensors.

In another embodiment, an image forming apparatus incorporates the fixing device as described above.

In yet another embodiment, a method of controlling the fixing device described above includes rotating a fixing rotator and a pressing member that presses against the fixing rotator to form a nip, heating the fixing rotator with a plurality of heat sources having different heat generation distributions in the longitudinal direction shielded by a shield, detecting a temperature of the fixing rotator by a plurality of temperature sensors disposed opposite to the heat source with the fixing rotator interposed between the heat source and the temperature sensor, controlling the heat source so that a temperature detected by a temperature sensor close to an entrance of the nip in the rotation direction of the fixing rotator among the plurality of temperature sensors becomes a predetermined target temperature T1, controlling the heat source so that a temperature detected by a temperature sensor far from the nip in the rotation direction of the fixing rotator among the plurality of temperature sensors becomes a predetermined target temperature T2, and controlling the heat source so that the temperature difference $\Delta T=T2-T1$ becomes positive.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
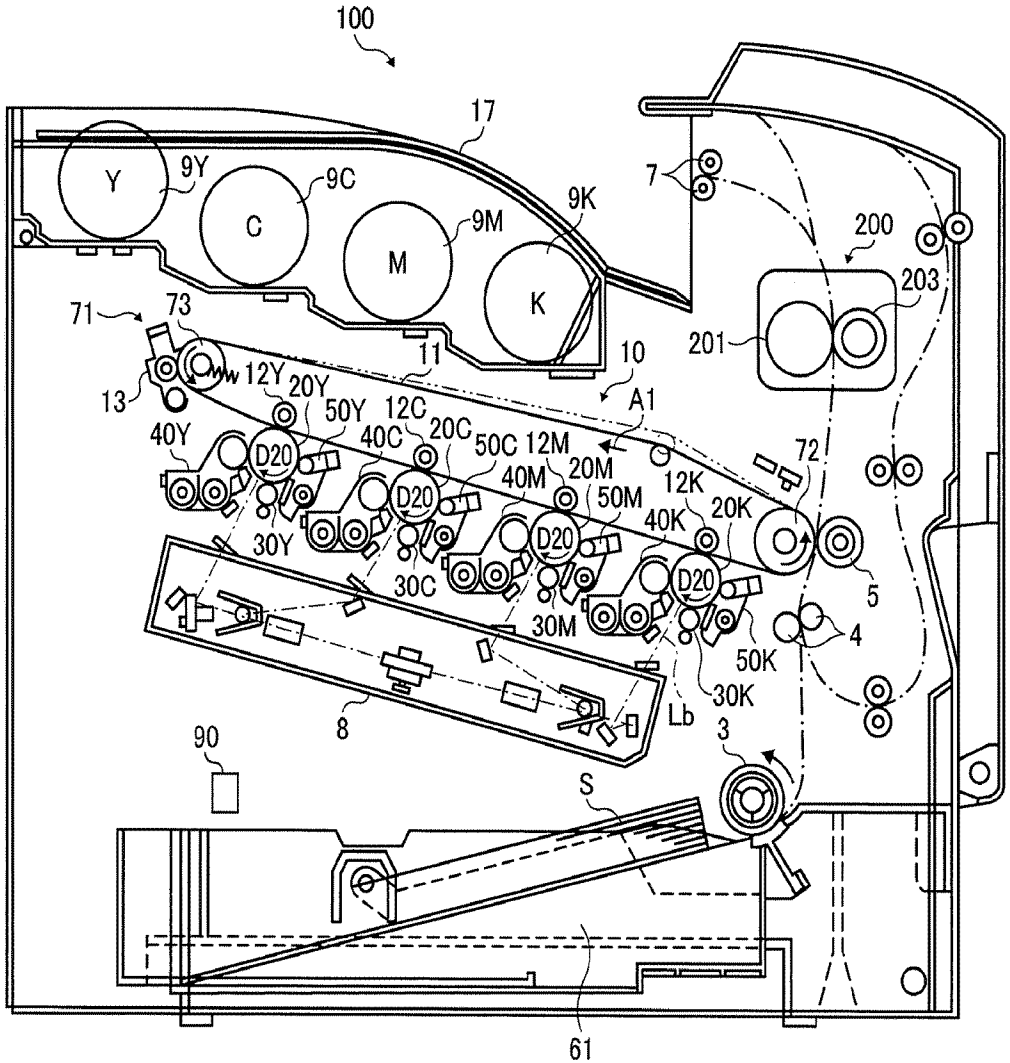
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

With reference to FIG. 1, a description is provided of a construction of the image forming apparatus 100.

The image forming apparatus 100 is a color printer employing a tandem system in which a plurality of image forming devices for forming toner images in a plurality of colors, respectively, is aligned in a rotation direction of a transfer belt. Alternatively, the image forming apparatus 100 may employ other systems and may be a copier, a facsimile machine, a printer, a multifunction peripheral or a multifunction printer (MFP) having at least one of copying, printing, scanning, facsimile, and plotter functions, or the like.

The image forming apparatus 100 employs a tandem structure in which four photoconductive drums 20Y, 20C, 20M, and 20K as image bearers that bear yellow, cyan, magenta, and black toner images in separation colors, respectively, are aligned.

The yellow, cyan, magenta, and black toner images formed on the photoconductive drums 20Y, 20C, 20M, and 20K, respectively, are primarily transferred successively onto an endless transfer belt 11 as an intermediate transferor disposed opposite the photoconductive drums 20Y, 20C, 20M, and 20K as the transfer belt 11 rotates in a rotation direction A1 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a recording medium S (e.g., a recording sheet) collectively in a secondary transfer process.

Each of the photoconductive drums 20Y, 20C, 20M, and 20K is surrounded by image forming components that form the yellow, cyan, magenta, and black toner images on the photoconductive drums 20Y, 20C, 20M, and 20K as the photoconductive drums 20Y, 20C, 20M, and 20K rotate clockwise in FIG. 1 in a rotation direction D20. Taking the photoconductive drum 20K that forms the black toner image, the following describes an image forming operation to form a black toner image.

The photoconductive drum 20K is surrounded by a charger 30K, a developing device 40K, a primary transfer roller 12K, and a cleaner 50K, in this order in the rotation direction D20 of the photoconductive drum 20K. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M, in this order in the rotation direction D20 of the photoconductive drums 20Y, 20C, and 20M, respectively. After the charger 30K charges the photoconductive drum 20K, an optical writing device 8 writes an electrostatic latent image on the photoconductive drum 20K with a laser beam Lb.

As the transfer belt 11 rotates in the rotation direction A1, the yellow, cyan, magenta, and black toner images formed on the photoconductive drums 20Y, 20C, 20M, and 20K, respectively, are primarily transferred successively onto the transfer belt 11, thus being superimposed on the same position on the transfer belt 11. In the primary transfer process, the primary transfer rollers 12Y, 12C, 12M, and 12K disposed opposite the photoconductive drums 20Y, 20C, 20M, and 20K via the transfer belt 11, respectively, apply a primary transfer bias to the photoconductive drums 20Y, 20C, 20M, and 20K successively from the upstream photoconductive drum 20Y to the downstream photoconductive drum 20K in the rotation direction A1 of the transfer belt 11.

The photoconductive drums 20Y, 20C, 20M, and 20K are aligned in this order in the rotation direction A1 of the transfer belt 11. The photoconductive drums 20Y, 20C, 20M, and 20K are located in four image forming stations that form the yellow, cyan, magenta, and black toner images, respectively.

The image forming apparatus 100 includes the four image forming stations, a transfer belt unit 10, a secondary transfer roller 5, a belt cleaner 13, and an optical writing device 8. The transfer belt unit 10 is situated above and disposed opposite the photoconductive drums 20Y, 20C, 20M, and 20K. The transfer belt unit 10 incorporates the transfer belt 11 and the primary transfer rollers 12Y, 12C, 12M, and 12K. The secondary transfer roller 5 is disposed outside and opposite the transfer belt 11 and is driven and rotated by the rotation of the transfer belt 11. The belt cleaner 13 is disposed opposite the transfer belt 11 to clean the transfer belt 11.

The optical writing device 8 is situated below and disposed opposite the four image forming stations. The optical writing device 8 includes a semiconductor laser as a light source, a coupling lens, an fθ lens, a toroidal lens, a deflection mirror, and a rotatable polygon mirror as a deflector. The optical writing device 8 emits light beams Lb for each of the yellow, cyan, magenta, and black toner images to be formed on the photoconductive drums 20Y, 20C, 20M, and 20K, forming electrostatic latent images on the photoconductive drums 20Y, 20C, 20M, and 20K, respectively. FIG. 1 illustrates one of the light beams Lb irradiating the photoconductive drum 20K. Similarly, light beams Lb irradiate the photoconductive drums 20Y, 20C, and 20M, respectively.

The image forming apparatus 100 further includes a sheet feeder 61 and a registration roller pair 4. The sheet feeder 61 incorporates a paper tray that loads a plurality of recording media S to be conveyed to a secondary transfer nip formed between the transfer belt 11 and the secondary transfer roller 5. The registration roller pair 4 conveys a recording medium S conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 100 further includes a sensor that detects a leading edge of the recording medium S as it reaches the registration roller pair 4.

The image forming apparatus 100 further includes a fixing device 200, an output roller pair 7, an output tray 17, and toner bottles 9Y, 9C, 9M, and 9K. The fixing device 200, as a fusing unit employing a belt fixing system, fixes a color toner image formed by the yellow, cyan, magenta, and black toner images secondarily transferred from the transfer belt 11 onto the recording medium S. The output roller pair 7 ejects the recording medium S bearing the fixed toner image from the image forming apparatus 100, that is, onto the output tray 17. The output tray 17 is disposed atop the image forming apparatus 100 and stacks the recording medium S ejected by the output roller pair 7. The toner bottles 9Y, 9C, 9M, and 9K are situated below the output tray 17 and are replenished with fresh yellow, cyan, magenta, and black toners, respectively as they run out of toner.

The transfer belt unit 10 includes a driving roller 72 and a driven roller 73 around which the transfer belt 11 is looped, in addition to the transfer belt 11 and the primary transfer rollers 12Y, 12C, 12M, and 12K.

Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12K, the secondary transfer roller 5, and the belt cleaner 13 together constitute a transfer device 71.

The sheet feeder 61 is situated in a lower portion of the image forming apparatus 100 and includes a feed roller 3 that contacts an upper side of an uppermost recording medium S of the plurality of recording media S loaded on the paper tray of the sheet feeder 61. As the feed roller 3 is driven and rotated counterclockwise in FIG. 1, the feed roller 3 feeds the uppermost recording medium S to the registration roller pair 4.

The belt cleaner 13 of the transfer device 71 includes a cleaning brush and a cleaning blade disposed opposite and contacting the transfer belt 11. The cleaning brush and the cleaning blade scrape a foreign substance such as residual toner particles off the transfer belt 11, removing the foreign substance from the transfer belt 11 and thereby cleaning the transfer belt 11. The belt cleaner 13 further includes a waste toner conveyer that conveys the residual toner particles removed from the transfer belt 11. In addition, the image forming apparatus 100 includes an ambient temperature sensor 90. The ambient temperature sensor 90 detects the ambient temperature of the image forming apparatus.

Figure 2:
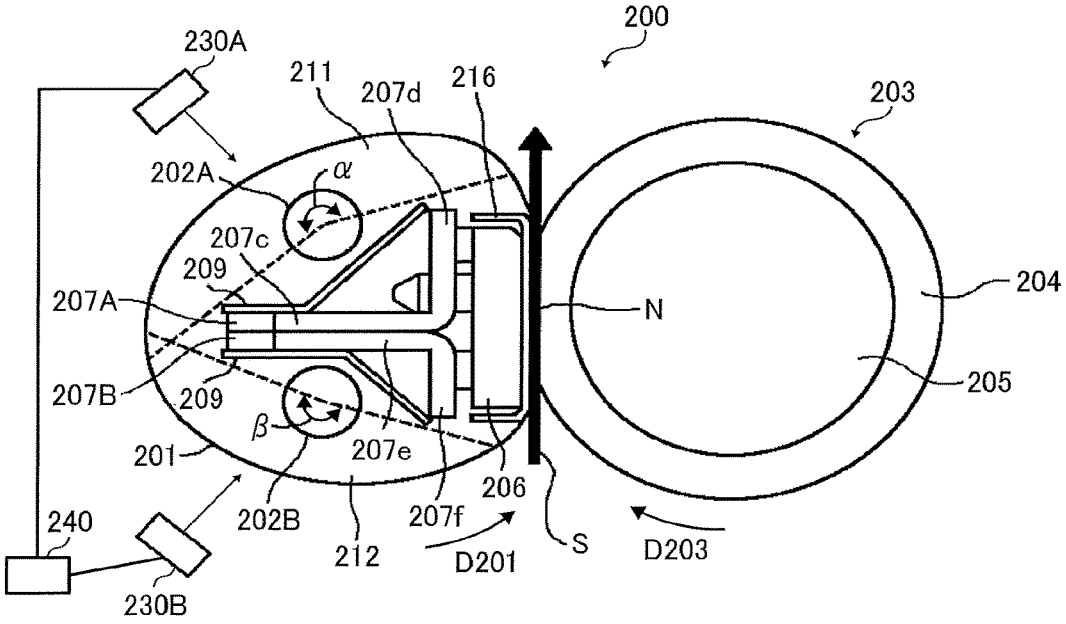
FIG. 2 is a cross-sectional view of a fixing device according to the embodiment.

With reference to FIG. 2, a description is provided of a construction of the fixing device 200 according to a first embodiment incorporated in the image forming apparatus 100 described above. FIG. 2 is a schematic vertical sectional view of the fixing device 200.

As illustrated in FIG. 2, the fixing device 200 includes a fixing belt 201 as a fixing rotator or an endless belt formed into a loop and rotatable in a rotation direction D201; a pressing roller 203 as a pressing rotator disposed opposite an outer circumferential surface of the fixing belt 201, which intermittently presses against the fixing belt 201 and is rotatable in a rotation direction D203 counter to the rotation direction D201 of the fixing belt 201; a plurality of heaters, that is, a halogen heater 202A as a primary heater and a halogen heater 202B as a secondary heater, disposed opposite an inner circumferential surface of the fixing belt 201 to heat the fixing belt 201 directly with radiant heat or light irradiating the inner circumferential surface of the fixing belt 201; a nip formation pad 206; a stay 207; and a reflector 209. The fixing belt 201 and the components disposed inside the loop formed by the fixing belt 201, that is, the halogen heaters 202A and 202B, the nip formation pad 206, the stay 207, and the reflector 209, may constitute a belt unit separably coupled with the pressing roller 203. Temperature sensors 230A and 230B to detect a temperature of the fixing belt 201 are set not to contact the fixing belt 201. A processor 240 controls a lighting rate of each of the halogen heaters 202A and 202B based on each of temperatures detected by the temperature sensors 230A and 230B, respectively, to keep the fixing belt 201 at a desired temperature. That is, the processor 240 controls heat generation of the halogen heaters 202A and 202B as a heat source (in reality, electrical power supply to the halogen heaters) so that the detected temperatures by the temperature sensors 230A and 230B become the predetermined target temperatures, respectively.

The fixing device 200 of the present embodiment includes two halogen heaters as heat sources. Heater 202A mainly heats the central portion of the sheet passing area, whereas heater 202B mainly heats the end portions of the sheet passing area.

The nip formation pad 206 is disposed inside the loop formed by the fixing belt 201 and presses against the pressing roller 203 via the fixing belt 201 to form a fixing nip N between the fixing belt 201 and the pressing roller 203 in FIG. 2. As the fixing belt 201 rotates in the rotation direction D201, the inner circumferential surface of the fixing belt 201 slides over the nip formation pad 206 indirectly, via a thermal conduction aid 216. As a recording medium S bearing a toner image is conveyed through the fixing nip N in a recording medium conveyance direction, the fixing belt 201 and the pressing roller 203 fix the toner image on the recording medium S under heat and pressure.

As illustrated in FIG. 2, the thermal conduction aid 216 is planar. Alternatively, the thermal conduction aid may be contoured into a recess or other shapes. If the fixing nip N defines the recess, the recessed fixing nip N directs the leading edge of the recording medium S toward the pressing roller 203 as the recording medium S is ejected from the fixing nip N, facilitating separation of the recording medium S from the fixing belt 201 and suppressing jamming of the recording medium S between the fixing belt 201 and the pressing roller 203.

The fixing device 200 includes the nip formation pad 206 disposed opposite to the pressing roller 203, the thermal conduction aid 216 that covers a surface opposite to the inner circumferential surface of the fixing belt 201 of the surface on the nip formation pad 206, a stay 207 as a support member that supports the nip formation pad 206 against pressing force from the pressing roller 203.

Each of the nip formation pad 206, the thermal conduction aid 216, and the stay 207 has a width not smaller than a width of the fixing belt 201 in the axial direction thereof parallel to a longitudinal direction of the nip formation pad 206, the thermal conduction aid 216, and the stay 207.

The length of the pressing roller 203 in the longitudinal direction is designed to be longer than the maximum sheet passing width that is 320 mm in the present embodiment to add the deviation of sheet setting position caused by users. The thermal conduction aid 216 is designed to be longer than the pressing roller 203. This is because the thermal conduction aid 216 shorter than the pressing roller 203 causes the fixing belt 201 to bend at a lateral end in the longitudinal direction of the thermal conduction aid 216 in the fixing nip N and break the fixing belt 201. Including variations during manufacturing, the thermal conduction aid 216 is designed to be longer than the pressing roller 203.

The thermal conduction aid 216 prevents heat generated by the halogen heater at lateral edges 202B from being stored locally and facilitates conduction of heat in the longitudinal direction of the thermal conduction aid 216, thus reducing uneven temperature of the fixing belt 201 in the axial direction thereof.

Hence, the thermal conduction aid 216 is made of a material that conducts heat quickly, for example, a material having an increased thermal conductivity such as copper, aluminum, and silver. It is preferable that the thermal conduction aid 216 is made of copper in a comprehensive view of manufacturing costs, availability, thermal conductivity, and processing. The thermal conduction aid 216 includes a nip formation face disposed opposite and in direct contact with the inner circumferential surface of the fixing belt 201.

A detailed description is now given of a construction of the fixing belt 201. The fixing belt 201 is an endless belt or film made of metal such as nickel and stainless steel (SUS) or resin such as polyimide. The fixing belt 201 is constructed of a base layer and a release layer. The release layer constituting an outer surface layer is made of Perfluoroalkoxy alkanes (PFA), polytetrafluoroethylene (PTFE), or the like to facilitate separation of toner of a toner image on the sheet S from the fixing belt 201, thus preventing the toner of the toner image from adhering to the fixing belt 201. An elastic layer may be sandwiched between the base layer and the release layer and made of silicone rubber or the like. If the fixing belt 201 does not incorporate the elastic layer, the fixing belt 201 has a decreased thermal capacity that improves fixing property of being heated quickly to a desired fixing temperature at which the toner image is fixed on the recording medium S. However, as the pressing roller 203 and the fixing belt 201 sandwich and press the unfixed toner image on the recording medium S passing through the fixing nip N, slight surface asperities of the fixing belt 201 may be transferred onto the toner image on the recording medium S, resulting in variation in gloss of the solid toner image that may appear as an orange peel image on the recording medium S. To address this circumstance, the elastic layer made of silicone rubber has a thickness not smaller than about 100 micrometers. As the elastic layer made of silicone rubber deforms, the elastic layer absorbs slight surface asperities in the fixing belt 124. Accordingly, formation of the faulty orange peel image is prevented. As a consequence, improved imaging quality can be provided.

The fixing nip N is formed between the fixing belt 201 and the pressing roller 203. When the recording medium S bearing the toner image passes through the fixing nip N, the heat melts toner and the pressing force fixes the toner on the recording medium.

The stay 207 has a shape having a projection projected from the opposite face to the fixing nip N side. The projection separates a first halogen heater 202A and a second halogen heater 202B as fixing heat sources from each other. The stay 207 functions as a shield. The halogen heaters 202A and 202B emit light that irradiates the inner circumferential surface of the fixing belt 201 directly through the opening of the stay 207, heating the fixing belt 201 with radiant heat.

A detailed description is now given of a configuration of the stay 207. The stay 207 as a support that supports the nip formation pad 206 to form the fixing nip N is situated inside the loop formed by the fixing belt 201. As the nip formation pad 206 receives pressure from the pressing roller 203, the stay 207 supports the nip formation pad 206 to prevent bending of the nip formation pad 206 and produce an even nip length in the recording medium conveyance direction throughout the entire width of the fixing belt 201 in an axial direction thereof. The stay 207 is mounted on and held by flanges as a holder at both lateral ends of the stay 207 in a longitudinal direction thereof parallel to the axial direction of the fixing belt 201, respectively, thus being positioned inside the fixing device 200. The reflector 209 interposed between the halogen heaters 202A and 202B reflects light radiated from the halogen heaters 202A and 202B to the reflector 209 toward the fixing belt 201, preventing the stay 207 from being heated by the halogen heaters 202A and 202B with radiant heat and the like and thereby reducing waste of energy. Therefore, the reflector 209 functions as the shield.

The reflector 209 interposed between the halogen heaters 202A and 202B also prevents one of the halogen heaters 202A and 202B from heating a glass tube of another heater, thereby enabling the fixing belt 201 to be heated effectively. The reflector 209 is made of a material having a low thermal emissivity so as not to absorb the heat of the halogen heater 202 as the heat source. The emissivity of the reflector 209 is at most 0.5, preferably 0.2 or less, more preferably 0.1 or less.

Alternatively, instead of the reflector 209, an opposed face of the stay 207 disposed opposite the halogen heaters 202A and 202B may be treated with insulation or a mirror finish to reflect light radiated from the halogen heaters 202A and 202B to the stay 207 toward the fixing belt 201.

A detailed description is now given of a construction of the pressing roller 203. The pressing roller 203 is constructed of a core bar 205, an elastic rubber layer 204 coating the core bar 205, and a surface release layer coating the elastic rubber layer 204 and made of PFA or PTFE to facilitate separation of the recording medium S from the pressing roller 203. As a driving force generated by a driver (e.g., a motor) disposed inside the image forming apparatus 100 depicted in FIG. 1 is transmitted to the pressing roller 203 through a gear train, the pressing roller 203 rotates in the rotation direction D203 as illustrated in FIG. 2. Alternatively, the driver may also be connected to the fixing belt 201 to drive and rotate the fixing belt 201. A spring or the like presses the pressing roller 203 against the nip formation pad 206 via the fixing belt 201. As the spring presses and deforms the elastic rubber layer 204 of the pressing roller 203, the pressing roller 203 produces the fixing nip N having the predetermined length in the recording medium conveyance direction. The pressing roller 203 may be a hollow roller or a solid roller. If the pressing roller 203 is a hollow roller, a heater such as a halogen heater may be disposed inside the hollow roller. The elastic rubber layer 204 may be made of solid rubber. Alternatively, if no heater is situated inside the pressing roller 203, the elastic rubber layer 204 may be made of sponge rubber. The sponge rubber is more preferable than the solid rubber because the sponge rubber has increased insulation that draws less heat from the fixing belt 201.

As the pressing roller 203 rotates in the rotation direction D203, the fixing belt 201 rotates in the rotation direction D201 with the rotation of the pressing roller 203 by friction therebetween. According to this embodiment, as the driver drives and rotates the pressing roller 203, a driving force of the driver is transmitted from the pressing roller 203 to the fixing belt 201 at the fixing nip N, thus rotating the fixing belt 201 by friction between the pressing roller 203 and the fixing belt 201. At the fixing nip N, the fixing belt 201 rotates as the fixing belt 201 is sandwiched between the pressing roller 203 and the nip formation pad 206; at a circumferential span of the fixing belt 201 other than the fixing nip N, the fixing belt 201 rotates while the fixing belt 201 is guided by a flange at each lateral end of the fixing belt 201 in the axial direction thereof.

With the construction described above, the fixing device 200 attaining quick warm-up is manufactured at reduced costs.

As illustrated in FIG. 2, the stay 207 includes a first part 207A and a second part 207B, each of which is substantially L-shaped in cross-section. The first part 207A includes a first partition 207*c* that shields the halogen heater 202A from the halogen heater 202B and a first mount 207*d* that mounts the nip formation pad 206. Similarly, the second part 207B includes a second partition 207*e* that shields the halogen heater 202B from the halogen heater 202A and a second mount 207*f* that mounts the nip formation pad 206. The first partition 207*c* and the second partition 207*e* have a substantially uniform length in a direction perpendicular to the longitudinal direction of the stay 207 throughout the entire width in the longitudinal direction of the stay 207. The first partition 207*c* and the second partition 207*e* extend linearly in the longitudinal direction of the halogen heaters 202A and 202B. The first partition 207*c* contacts the second partition 207*e* to define the substantially T-shaped stay 207 in cross-section. The first partition 207*c* and the second partition 207*e* divide an interior of the fixing belt 201 into a first compartment 211 and a second compartment 212 that are same in size.

As described above, the two halogen heaters 202A and 202B are disposed in two different compartments defined by the stay 207 as a partition, that is, a first compartment 211 as a downstream compartment and a second compartment 212 as an upstream compartment in the rotation direction D201 of the fixing belt 201. Accordingly, while the halogen heaters 202A and 202B are powered on, the glass tubes of the halogen heaters 202A and 202B do not heat each other, preventing degradation in heating efficiency of the halogen heaters 202A and 202B.

Figure 3:
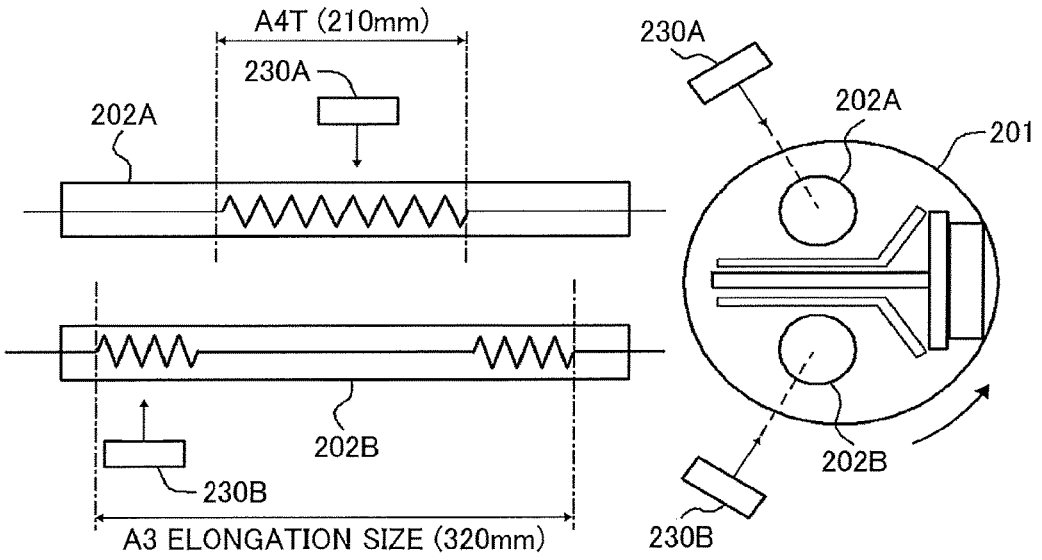
FIG. 3 is a schematic diagram illustrating an arrangement of a plurality of heaters included in the fixing device of the embodiment.

FIG. 3 is a schematic diagram illustrating an arrangement of a plurality of heaters included in a fixing device. The shape of the stay 207 and the reflector 209 of the fixing device 200 depicted in FIG. 3 is different from the shape of the stay 207 and the reflector 209 of the fixing device 200 depicted in FIG. 2. The configuration in FIG. 2 is similar to the configuration described in FIG. 3.

As noted above, the halogen heaters 202A and 202B heat different regions in the longitudinal direction. The heat generation region of the halogen heater 202A is distributed with the center in the longitudinal direction as the axis of symmetry, and has the smaller length of the sheet size A4 (that is, 210 mm, A4T in FIG. 3) as a whole. The heat generation region of the halogen heater 202B has a length of A3 elongation size (that is, 320 mm) as a whole, but the heat generation region of the halogen heater 202A is excluded. The halogen heater 202B does not generate heat in the heat generation region of the halogen heater 202A. When the sheet size is equal to or smaller than 210 mm, only the heater 202A is turned on to heat the fixing belt 201, and when the sheet size exceeds 210 mm, the both heaters 202A and 202B are turned on to heat the fixing belt 201. This arrangement enables continuous printing without lowering the throughput due to overheating at the non-sheet passing portion even when the sheet size is equal to or less than the smaller length of the sheet size A4.

A processor (e.g., the processor 240), that is, a central processing unit (CPU) provided with a random-access memory (RAM) and a read-only memory (ROM), for example, and operatively connected to the temperature sensors 230A and 230B and the halogen heaters 202A and 202B, controls the halogen heaters 202A and 202B based on temperatures of the outer circumferential surface of the fixing belt 201 detected by the temperature sensors 230A and 230B. As illustrated in FIG. 3, it is preferable that the temperature sensors 230A and 230B face the heaters 202A and 202B, respectively, across the fixing belt 201. This configuration enables detection of a high temperature of the fixing belt 201 early to stop the operation of the image forming apparatus 100 when a malfunction occurs in the fixing device 200 and the halogen heaters do not turn off. That is, since the fixing belt portion closest to the halogen heater attains the highest temperature, it is preferable that the temperature sensor is disposed on a line connecting the halogen heater and the fixing belt portion that is the shortest distance from the halogen heater. Therefore, the temperature sensors 230A and 230 B detect the temperature on positions that are far apart in the circumferential direction of the fixing belt.

To facilitate an understanding of the present disclosure, for comparison the relation between the heat generation region of the halogen heater and the position of the temperature sensor in the comparative example according to the background art is described.

Figure 4:
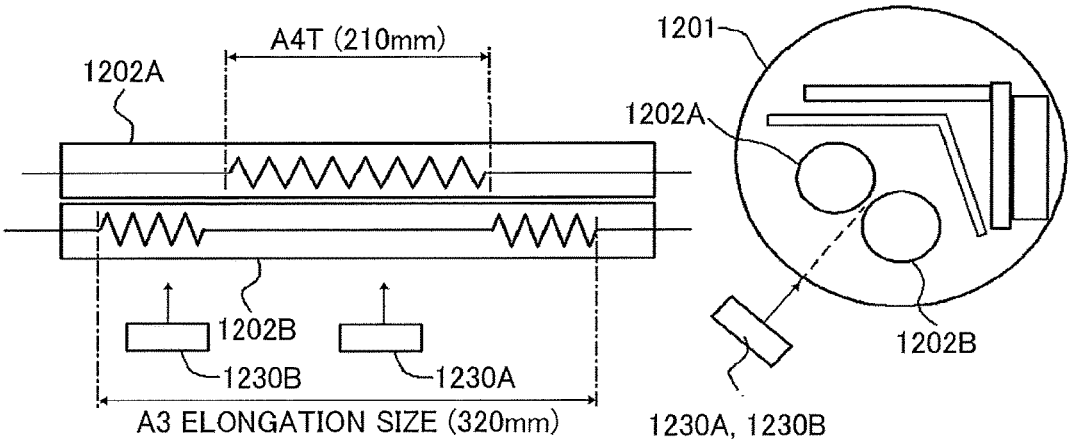
FIG. 4 is a schematic diagram illustrating an arrangement of a plurality of heaters in a fixing device according to a background art.

FIG. 4 is a schematic diagram illustrating an arrangement of a plurality of heaters in the fixing device according to a background art. The heat generation region of the halogen heater is the same as in FIG. 3. As illustrated in FIG. 4, the temperature sensors 1230A and 1230B are disposed at substantially the same position in the circumferential direction of the fixing belt 1201. This is because the halogen heaters 1202A and 1202B are arranged close to each other and have substantially the same position where the fixing belt becomes hot. In the axial direction, the temperature sensor is disposed at the heat generation region of each heater.

The reflector 209 interposed between the halogen heaters 202A and 202B in the configuration of FIG. 2 makes it possible to heat the fixing belt 201 effectively. In a printing test using the image forming apparatus 100 in FIG. 2 under fixing device control according to the background art, the following phenomenon occurred: In a fixed image, a fix strength difference and glossiness difference occurred between the images corresponding to the heat generation regions of the halogen heaters 202A and 202B. It was found that the fixing belt temperature immediately before contact with the toner (hereinafter referred to as the fixing nip belt temperature) differed significantly between the heat generation regions of the halogen heaters 202A and 202B, for the reason described below with reference to FIGS. 5A, 5B, 6A, and 6B.

Figure 5A:
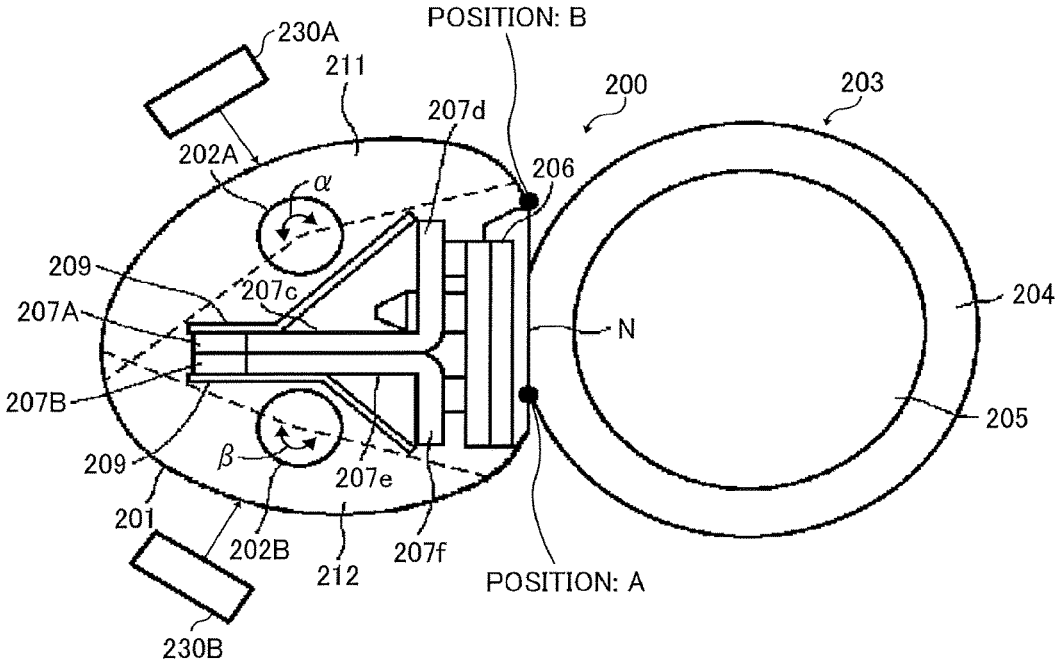
FIG. 5A BACKGROUND ART
FIG. 5A is a cross-sectional view of the fixing device in which a fixing temperature is controlled by a background art.
Figure 5B:
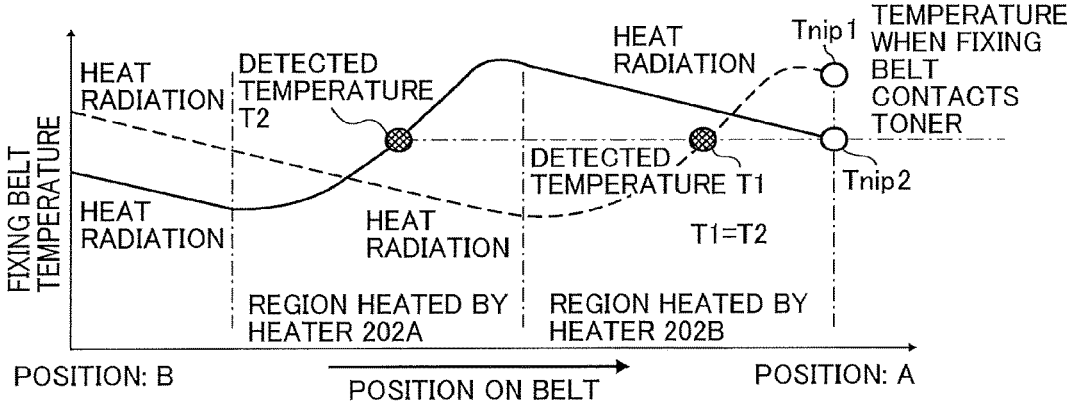
FIG. 5B is a graph illustrating a temperature distribution in the circumferential direction of a fixing belt in the fixing device of the fixing device illustrated in FIG. 5A.
Figure 6A:
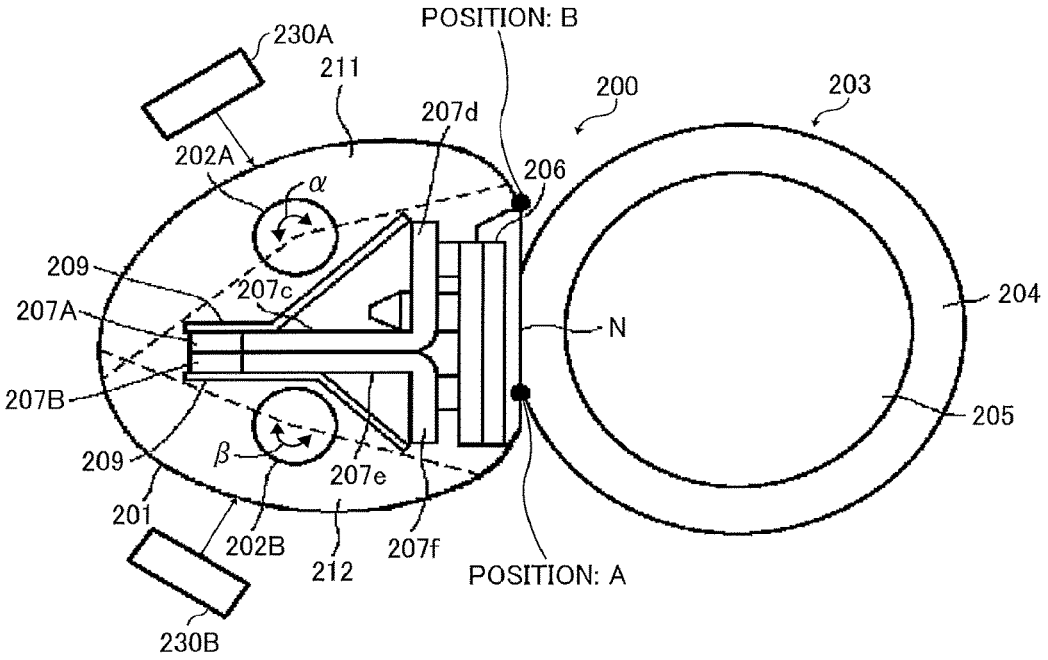
FIG. 6A is a cross-sectional view of the fixing device in which the fixing temperature is controlled by the control method of the present disclosure.
Figure 6B:
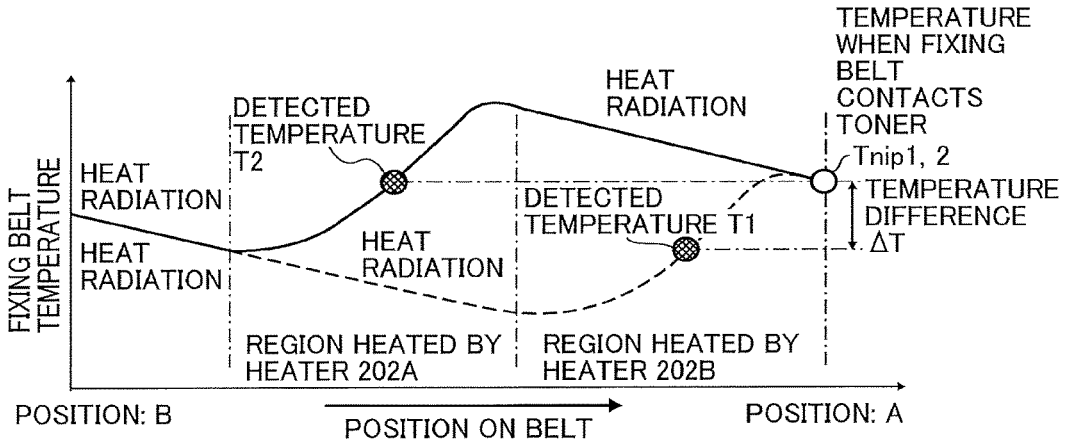
FIG. 6B is a graph illustrating a temperature distribution in the circumferential direction of the fixing belt in the fixing device of FIG. 6A.

FIGS. 5A, 5B, 6A and 6B are cross-sectional views and graphs for illustrating a comparison between a fixing temperature control according to the present embodiment of the present disclosure and a fixing temperature control according to the background art. FIGS. 5A and 5B are the cross-sectional view and a graph illustrating the fixing temperature control according to the background art, and FIGS. 6A and 6B are the cross-sectional view and a graph illustrating the fixing temperature control according to the embodiment of the present disclosure. FIGS. 5B and 6B are graphs illustrating fixing belt temperature distributions in the circumferential direction of the fixing belt 201. The configuration of the fixing device 200 illustrated in FIGS. 5A and 6A is the same as the configuration in FIG. 2, and the reference codes are also the same.

In the background art, the processor 240 controls the halogen heaters 202A and 202B so that the temperatures Tsen2 and Tsen1 detected by the temperature sensors 230A and 230B become a same temperature. As illustrated in FIG. 5B, this control results in a great temperature difference between a second fixing belt nip temperature Tnip2 corresponding to the heat generation region of the halogen heater 202A and a first fixing belt nip temperature Tnip1 corresponding to the heat generation region of the halogen heater 202B, which are temperatures when fixing belt 201 contacts toner, that is, temperatures at position A in FIG. 5A that is an entrance of the fixing nip.

This is because the detection positions of the temperature sensors 230A and 230B greatly differ in the circumferential direction of the fixing belt 201. The temperature sensor 230A detects the fixing belt temperature at a position far from the fixing nip. After the fixing belt is heated by the halogen heater 202A and the fixing belt temperature rises, the fixing belt temperature decreases due to heat radiation to reach the second fixing belt nip temperature Tnip2.

On the other hand, the temperature sensor 230B detects the fixing belt temperature at a position near the fixing nip. After the temperature of the fixing belt 201 passing through the fixing nip decreases due to heat radiation, the temperature sensor 230B detects the decreased temperature, and the halogen heater 202B heats the fixing belt 201. The fixing belt 201 heated by the heater 202B reaches the fixing nip without heat radiation and the fixing belt temperature at the position A becomes the first fixing belt nip temperature Tnip1.

In other words, the temperature sensor 230A detects the temperature before the fixing belt temperature decreases due to heat radiation, and the fixing belt nip temperature Tnip1 depends on temperature drop due to heat radiation and temperature rise due to heating by heater 202A that is controlled by the processor 240 based on the temperature Tsen1 detected by the temperature sensor 230A.

The temperature sensor 230B detects the temperature after the fixing belt temperature decreases due to heat radiation and the fixing belt nip temperature Tnip2 depends on temperature rise due to heating by heater 202B that is controlled by the processor 240 based on the temperature Tsen2 detected by the temperature sensor 230B. The temperature drop due to heat radiation is small. Therefore, when a difference between the detected temperature Tsen2 and the fixing belt nip temperature Tnip2 is small, a fixing belt temperature control based on a same target temperature results in a big difference between the detected temperature Tsen1 and the actual fixing belt nip temperature Tnip1

Therefore, as illustrated in FIG. 6B, in order to make the fixing belt nip temperatures Tnip1 and Tnip2 equal to each other, a control target temperature of the temperature sensor 230A needs to be higher than a control target temperature of the temperature sensor 230B.

With reference to FIG. 4, the fixing belt temperature of the fixing device configuration according to the background art is described.

As illustrated in FIG. 4, the halogen heaters 1202A and 1202B are disposed close to each other, and the temperature sensors 1230A and 1230B detect the fixing belt temperature at almost the same position in the circumferential direction of the fixing belt 201. Even if positions detected by the temperature sensors 1230A and 1230B are slightly displaced, difference of the positions is much smaller than the one in FIG. 3. Therefore, setting the same control target temperatures for the temperature sensor 1230 A and the temperature sensor 1230 B equalizes the fixing belt nip temperatures Tnip1 and Tnip2.

However, applying above described temperature control to the fixing device having the configuration in FIG. 2 and FIG. 3 results in the great temperature difference between the second fixing belt nip temperature Tnip2 corresponding to the heat generation region of the halogen heater 202A and the first fixing belt nip temperature Tnip1 corresponding to the heat generation region of the halogen heater 202B.

Therefore, in the present embodiment, as described above, the control target temperature of the temperature sensor 230 A is set higher than the control target temperature of the temperature sensor 230 B, in other words, the control target temperature of the temperature sensor 230 B close to the nip entrance, which is referred to as a target temperature T1, is set smaller than the control target temperature of the temperature sensor 230A far from the nip entrance, which is referred to as a target temperature T2. Since this makes it possible to set the target temperature considering the heat radiation from the fixing belt, this fixing temperature control has an effect that this control enables the first fixing belt nip temperature Tnip1 to be the same as the second fixing belt nip temperature Tnip2. That is, in the fixing device configuration in which a plurality of heat sources, that is, fixing heaters are disposed on both sides of the reflector 209, the fixing rotator temperature when the fixing rotator contacts the toner is made the same regardless of the heat generation region of the heater. This makes it possible to prevent occurring the fixing strength difference and glossiness difference.

Specifically, when the target temperature of the temperature sensor 230B close to the entrance of the fixing nip is T1 and the target temperature of the temperature sensor 230A far from the entrance of the fixing nip is T2 in the circumferential direction of the fixing belt 201, the processor 240 controls the heaters 202A and 202B such that a temperature difference $\Delta T = T2 - T1$ becomes positive (>0). Additionally, the processor changes $\Delta T$ according to the environment and linear velocity of the fixing belt 201.

Since the heat radiation amount of the fixing belt varies depending on a distance between a fixing belt position heated by the heater and the entrance of the fixing nip, the temperature detected by the temperature sensor 230A far from the entrance of the fixing nip drops greatly due to large heat radiation and becomes the fixing belt nip temperature Tnip2 that is the temperature when the fixing belt contacts the toner. On the other hand, the temperature detected by the temperature sensor 230B close to the entrance of the fixing nip does not drop greatly due to the heat radiation. The processor 240 of the present embodiment sets the above described temperature difference $\Delta T$ to a temperature difference corresponding to heat radiation difference caused by a distance difference of heaters 202A and 202B, that is, the target temperature T2 higher by the temperature difference $\Delta T$ than the target temperature T1 and controls the heaters 202A and 202B. This control makes the fixing belt nip temperature Tnip1 equal to the fixing belt nip temperature Tnip2, which are the fixing belt temperature when the fixing belt contacts the toner.

The processor 240 sets the temperature sensor differences $\Delta T$ between the target temperatures of a plurality of temperature sensors in different fixing linear velocities. In the image forming apparatus of the present embodiment, the fixing linear velocity can be changed to improve fixing performance of thick paper. When the user inputs the use of thick paper on an operation panel to use the thick paper, the processor of the image forming apparatus reduces the rotation speed of a main motor, slows the driving of the image forming apparatus, and reduces the linear velocity of the fixing belt.

When the temperature difference ΔT is a temperature difference between the target temperatures of the temperature sensors 230A and 230B, that is, the temperature difference between the control target temperatures which the processor 240 use to control the halogen heaters 202A and 202B based on the temperatures detected by the temperature sensors 230A and 230B, a slow fixing velocity, that is, a slow velocity of the fixing belt 201 needs setting the temperature difference ΔT to a large value.

This is because the heat radiation affects the temperature difference between the temperature detected by the temperature sensor 230A and the fixing belt nip temperature Tnip2 and the temperature difference between the temperature detected by the temperature sensor 230B and the fixing nip portion temperature Tnip1. The slower the linear velocity of the fixing belt becomes, the longer the time needs from time in which the temperature sensor detects the temperature of the fixing belt to time in which the fixing belt part detected the temperature by the temperature sensor reaches the fixing belt nip. As a result, the heat radiation amount increases, and the temperature difference between the temperature detected by the temperature sensor and the fixing belt nip temperature increases.

A following table 1 is a specific example of the fixing linier velocities and the temperature differences corresponding to the fixing linier velocities.

TABLE 1

| Linear velocity [mm/sec] | Temperature difference ΔT [deg] |
|---|---|
| 250 | 8 |
| 150 | 12 |
| 50 | 20 |

Table 1 is the example when the ambient temperature is 23° C. When the linear velocity of the fixing belt 201 is 50 mm/sec, the processor 240 sets the temperature difference to 20 degrees, when the linear velocity of the fixing belt 201 is 150 mm/sec, the processor 240 sets the temperature difference to 12 degrees, and when the linear velocity of the fixing belt 201 is 250 mm/sec, the processor 240 sets the temperature difference to 8 degrees. In the above described example, the fixing linier velocity is witched to three velocities, but the present disclosure is not limited to this. The temperature difference ΔT corresponding to the linear velocity in table 1 is just an example and set appropriately depending on the fixing device configuration, size, and used materials.

Next, how the processor 240 sets the temperature sensor differences ΔT between the target temperatures of a plurality of temperature sensors in different ambient temperature of the image forming apparatus is described.

When the temperature difference ΔT is a temperature difference between the target temperatures of the temperature sensors 230A and 230B, that is, the temperature difference between the control target temperatures which the processor 240 use to control the halogen heaters 202A and 202B based on the temperatures detected by the temperature sensors 230A and 230B, lower ambient temperature needs setting the temperature difference ΔT to a larger value. This is because the heat radiation affects the temperature difference between the temperature detected by the 230A and the nip temperature Tnip2 and the temperature difference between the temperature detected by the temperature sensor 230B and the fixing nip portion temperature Tnip1. The lower the ambient temperature becomes, the greater the temperature difference between the fixing belt and outside temperature becomes. As a result, the heat radiation amount increases, and the temperature difference between the temperature detected by the temperature sensor and the fixing belt nip temperature increases.

A following table 2 is a specific example of the ambient temperatures and the temperature differences corresponding to the ambient temperatures.

TABLE 2

| Ambient temperature [° C.] | Temperature difference ΔT [deg] |
|---|---|
| 15 | 10 |
| 25 | 8 |
| 35 | 6 |

Table 2 is the example when the fixing linier velocity is 250 mm/sec. When the ambient temperature is 15° C., the processor 240 sets the temperature difference to 10 degrees, when the ambient temperature is 25° C., the processor 240 sets the temperature difference to 8 degrees, and when the ambient temperature is 35° C., the processor 240 sets the temperature difference to 6 degrees. In the above described example, the temperature difference is set for the three ambient temperatures, but the present disclosure is not limited to this. The temperature difference ΔT corresponding to the ambient temperature in table 2 is just an example and set appropriately depending on the fixing device configuration, size, and used materials.

As described above, in the fixing device of the present disclosure and the image forming apparatus installed the fixing device having the fixing device configuration in which a plurality of heat sources (for example, halogen heaters) are disposed on both sides of the reflector, when the target temperature of the temperature sensor 230B close to the entrance of the fixing nip is T1 and the target temperature of the temperature sensor 230A far from the entrance of the fixing nip is T2 in the circumferential direction of the fixing rotator (ex. the fixing belt 201), the processor 240 controls the heaters 202A and 202B such that a temperature difference ΔT=T2−T1 becomes positive (>0). This makes the temperature when the fixing rotator contacts the toner become the same regardless of the heat generation region of the heater, which makes it possible to prevent occurring the fixing strength difference and glossiness difference.

Setting the temperature difference ΔT to the greater value for the slower linier velocity of the fixing rotator makes the fixing rotator temperature when the fixing rotator contacts the toner in the fixing nip become the same regardless of the different fixing velocity and the heat generation region of the heater. This makes it possible to prevent occurring the fixing strength difference and glossiness difference.

Setting the temperature difference ΔT to the greater value for the lower ambient temperature can cover a difference of the heat radiation amount due to the ambient temperature and makes the fixing rotator temperature when the fixing rotator contacts the toner in the fixing nip become the same regardless of the different ambient temperature and the heat generation region of the heater. This makes it possible to prevent occurring the fixing strength difference and glossiness difference.

The configuration of the fixing devices 200 is not limited to the embodiments described above. For example, the heat source of the fixing device 200 is not limited to the halogen heater, but any suitable heat source can be adopted as long as the present disclosure can be applied. In addition, the heat distribution of the heater is also an example, and the present disclosure is also applicable to an appropriate configuration.

The image forming apparatus may have any configuration as long as the present disclosure is applicable. The image forming apparatus is not limited to a printer as described above and may be a copier, a facsimile machine, or a multi-function device having a plurality of functions thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a fixing rotator rotatable in a predetermined direction of rotation;

a plurality of heat sources having different heat distributions in a longitudinal direction of the fixing rotator to heat the fixing rotator;

a pressing member to press against the fixing rotator such that a recording material bearing an unfixed toner image passes a fixing nip between the pressing member and the fixing rotator to fix the unfixed toner image on the recording material;

a shield disposed between the plurality of heat sources;

a plurality of temperature sensors, each disposed opposite a respective one of the plurality of heat sources, with the fixing rotator interposed between the heat source and the temperature sensor; and a processor to control the plurality of heat sources so that a temperature difference $\Delta T=T2-T1$ becomes greater than zero, wherein T1 is a target temperature for a temperature sensor closest to an entrance of the fixing nip among the plurality of temperature sensors, and T2 is a target temperature for a temperature sensor farthest from the entrance of the fixing nip among the plurality of temperature sensors.

2. The fixing device according to claim 1, wherein, as a linear velocity of the fixing rotator decreases, the processor increases the temperature difference $\Delta T$.

3. The fixing device according to claim 1, further comprising an ambient temperature sensor to detect an ambient temperature, wherein the processor increases the temperature difference $\Delta T$ as the ambient temperature detected by the ambient temperature sensor decreases.

4. The fixing device according to claim 1, wherein the shield is made of a material having low emissivity.

5. The fixing device according to claim 1, further comprising:

a nip formation pad disposed inside a loop formed by the fixing rotator to press the fixing rotator against the pressing member; and a support member to support the nip formation pad, wherein the shield is attached to the support member.

6. An image forming apparatus comprising the fixing device according to claim 1.

7. A fixing device control method, comprising:

rotating a fixing rotator and a pressing member that presses against the fixing rotator to form a nip;

heating the fixing rotator with a plurality of heat sources having different heat generation distributions in a longitudinal direction, the plurality of heat sources shielded by a shield;

detecting a temperature of the fixing rotator by a plurality of temperature sensors, each disposed opposite a respective one of the plurality of heat sources, with the fixing rotator interposed between the heat source and the temperature sensor;

with a processor, controlling the heat source so that:

a temperature detected by a temperature sensor closest to an entrance of the nip in a rotation direction of the fixing rotator among the plurality of temperature sensors becomes a predetermined target temperature T1;

a temperature detected by a temperature sensor farthest from the nip in the rotation direction of the fixing rotator among the plurality of temperature sensors becomes a predetermined target temperature T2; and a temperature difference $\Delta T=T2-T1$ becomes positive.

* * * * *